US009746209B2

(12) United States Patent
Shaprio et al.

(10) Patent No.: US 9,746,209 B2
(45) Date of Patent: Aug. 29, 2017

(54) MODULAR LOW CHARGE HYDROCARBON REFRIGERATION SYSTEM AND METHOD OF OPERATION

(71) Applicant: Hussmann Corporation, Bridgeton, MO (US)

(72) Inventors: Doron Shaprio, St. Louis, MO (US); Norman E. Street, O'Fallon, MO (US); Chiao M. Lee, St. Charles, MO (US)

(73) Assignee: Hussman Corporation, Bridgeton, MO (US)

( * ) Notice: Subject to any disclaimer, the term of this patent is extended or adjusted under 35 U.S.C. 154(b) by 410 days.

(21) Appl. No.: 14/210,745

(22) Filed: Mar. 14, 2014

(65) Prior Publication Data

US 2015/0257549 A1 Sep. 17, 2015

(51) Int. Cl.
*F25B 7/00* (2006.01)
*F25B 1/00* (2006.01)
(Continued)

(52) U.S. Cl.
CPC ..... *F25B 1/005* (2013.01); *A47F 3/0482* (2013.01); *F25B 25/005* (2013.01);
(Continued)

(58) Field of Classification Search
CPC .... F25B 1/005; F25B 25/005; F25B 2400/12; F25B 29/003; A47F 3/04; A47F 3/0482; F25D 17/02
(Continued)

(56) References Cited

U.S. PATENT DOCUMENTS 5,440,894 A 8/1995 Schaeffer et al.
5,701,750 A 12/1997 Ray
(Continued)

FOREIGN PATENT DOCUMENTS

EP 1475588 11/2004
EP 1734318 12/2006
(Continued)

OTHER PUBLICATIONS

Search Report of the International Search Authority for Application No. PCT/US2015/013002 dated Apr. 29, 2015 (5 pages).
(Continued)

*Primary Examiner* — Len Tran
*Assistant Examiner* — Ana Vazquez
(74) *Attorney, Agent, or Firm* — Michael Best & Friedrich LLP

(57) ABSTRACT

A modular refrigeration system includes a refrigeration loop having a compressor, a condenser, an expansion assembly, and a chiller interconnected by a first piping loop cycling hydrocarbon refrigerant. A high side cooling loop includes a first heat exchanger and a first pump interconnected with the condenser by a second piping loop cycling a cooling fluid, the cooling fluid exchanges heat with the hydrocarbon refrigerant at the condenser. A low side cooling loop includes a second heat exchanger and a second pump interconnected with the chiller by a third piping loop cycling a chilled fluid, the chilled fluid exchanges heat with the hydrocarbon refrigerant at the chiller. A space supports the second heat exchanger and is configured to be maintained within a predetermined temperature range, wherein the total charge of hydrocarbon refrigerant associated with the space does not exceed 150 grams.

6 Claims, 3 Drawing Sheets

(51) Int. Cl.

| | |
|---|---|
| ***A47F 3/04*** | (2006.01) |
| ***F25B 25/00*** | (2006.01) |
| ***F25B 29/00*** | (2006.01) |
| ***F25D 17/02*** | (2006.01) |

(52) U.S. Cl.
CPC ..... *F25B 29/003* (2013.01); *F25D 17/02* (2013.01); *F25B 2400/12* (2013.01); *F25B 2400/22* (2013.01)

(58) Field of Classification Search
USPC ..... 62/175
See application file for complete search history.

(56) References Cited

U.S. PATENT DOCUMENTS

| | | | | |
|---|---|---|---|---|
| 5,802,860 | A | 9/1998 | Barrows | |
| 6,085,531 | A * | 7/2000 | Numoto | F24F 11/0086 62/129 |
| 6,131,401 | A * | 10/2000 | Ueno | A47F 3/04 165/208 |
| 6,370,895 | B1 | 4/2002 | Sakuma et al. | |
| 6,415,620 | B1 | 7/2002 | Ferdows | |
| 6,553,778 | B2 | 4/2003 | Tipton et al. | |
| 6,581,405 | B2 | 6/2003 | Kim et al. | |
| 6,644,049 | B2 | 11/2003 | Alford | |
| 7,137,266 | B2 | 11/2006 | Kim et al. | |
| 7,219,505 | B2 | 5/2007 | Weber et al. | |
| 7,231,774 | B2 | 6/2007 | Taras et al. | |
| 7,765,831 | B2 | 8/2010 | Rodriguez et al. | |
| 7,886,556 | B2 | 2/2011 | Fujiyoshi et al. | |
| 7,908,881 | B2 | 3/2011 | Kopko | |
| 8,161,763 | B2 | 4/2012 | Yun et al. | |
| 2005/0086952 | A1 | 4/2005 | Nonaka et al. | |
| 2006/0108304 | A1 * | 5/2006 | Kanou | A47F 3/04 211/119.003 |
| 2009/0056353 | A1 | 3/2009 | Sunderland | |
| 2009/0120117 | A1 | 5/2009 | Martin et al. | |
| 2009/0183519 | A1 | 7/2009 | Nishikawa et al. | |
| 2010/0281882 | A1 | 11/2010 | Heinbokel et al. | |
| 2010/0300129 | A1 | 12/2010 | Bean, Jr. et al. | |
| 2011/0277498 | A1 | 11/2011 | Kaart | |
| 2012/0023978 | A1 | 2/2012 | Chae et al. | |
| 2012/0023983 | A1 | 2/2012 | Glaros | |
| 2012/0174604 | A1 | 7/2012 | Thøgersen et al. | |
| 2012/0180986 | A1 | 7/2012 | Mathews | |
| 2013/0167577 | A1 | 7/2013 | Street et al. | |
| 2013/0180268 | A1 | 7/2013 | Schlosser et al. | |
| 2013/0205821 | A1 | 8/2013 | Shapiro | |

FOREIGN PATENT DOCUMENTS

| | | |
|---|---|---|
| EP | 1987301 | 11/2008 |
| WO | 9923425 | 5/1999 |
| WO | 2008112554 | 9/2008 |

OTHER PUBLICATIONS

Written Opinion of the International Search Authority for Application No. PCT/US2015/013002 dated Apr. 29, 2015 (10 pages).
First Examination Report from the Intellectual property Office of New Zealand for Application No. 619157 dated Jan. 6, 2014 (2 pages).

* cited by examiner

MODULAR LOW CHARGE HYDROCARBON REFRIGERATION SYSTEM AND METHOD OF OPERATION

BACKGROUND

The present invention relates to refrigeration systems and, more specifically, to a modular refrigeration system utilizing a low charge hydrocarbon refrigerant.

A refrigerated merchandiser is generally known in the art. A refrigerated merchandiser is used by grocers, convenience stores, or other sellers of food items to store and display food items within a predetermined temperature range. Refrigerated merchandisers may employ different refrigerants to maintain the predetermined temperature range. Examples of refrigerants may include, but are not limited to, hydrofluorocarbons (HFC), perfluorocarbons (PFC), HFC blends (including R-404A and R-407A), ammonia, carbon dioxide, and hydrocarbons.

Unlike inert refrigerants, hydrocarbon refrigerants have additional government regulations due to flammability and/or toxicity. Typically, regulations focus on limiting the quantity of hydrocarbon refrigerant in a single refrigeration circuit. For example, propane is an approved hydrocarbon for use as a refrigerant in certain applications, including commercial refrigerated merchandisers. However, the Environmental Protection Agency (EPA) regulates the amount of propane which may be used to charge a single refrigeration circuit. For example, the EPA typically limits the refrigerant charge in a refrigeration circuit to 150 grams or less of propane refrigerant. This is for safety purposes in order to limit the potential for a dangerous ignition should the propane refrigerant leak from the refrigeration circuit.

In order to meet commercial refrigeration demands while also complying with hydrocarbon charge regulations, a single commercially available refrigerated merchandiser will typically employ a plurality of refrigeration circuits that operate in parallel. Each refrigeration circuit will have a refrigeration charge of no more than 150 grams of hydrocarbon refrigerant. The refrigeration circuits cooperatively operate to provide a desired amount of refrigeration.

However, refrigerated merchandisers employing a plurality of refrigeration circuits have certain undesirable characteristics. For example, additional components are necessary to operate each of the separate refrigeration circuits. The additional components may include, but are not limited to, additional piping, compressors, condensers, and control technology to achieve a desired amount of refrigeration in the merchandiser. These additional components not only increase initial costs of constructing refrigerated merchandiser systems, but typically lead to higher maintenance costs to maintain the additional components over the life of the systems. Also, the parallel refrigeration circuits in commercially available merchandisers do not maximize cooling load. Instead, the total amount of hydrocarbon refrigerant associated with the merchandiser is increased. So while each refrigeration circuit complies with government regulations, the total amount of hydrocarbon refrigerant associated with the merchandiser exceeds 150 grams, and typically is between 150 and 600 grams.

SUMMARY OF THE INVENTION

The invention provides, in one aspect, a modular refrigeration system. The system includes a refrigeration loop having a compressor, a condenser, an expansion assembly, and a chiller interconnected by a first piping loop, the first piping loop cycles hydrocarbon refrigerant. A high side cooling loop includes a first heat exchanger and a first pump interconnected with the condenser by a second piping loop, the second piping loop cycles a cooling fluid, the cooling fluid exchanges heat with the hydrocarbon refrigerant at the condenser. A low side cooling loop includes a second heat exchanger and a second pump interconnected with the chiller by a third piping loop, the third piping loop cycles a chilled fluid, the chilled fluid exchanges heat with the hydrocarbon refrigerant at the chiller. A space supports the second heat exchanger and is configured to be maintained within a predetermined temperature range, wherein the total charge of hydrocarbon refrigerant associated with the space does not exceed 150 grams.

The invention provides, in another aspect, a refrigeration system. The system includes a refrigeration loop having a compressor, a first heat exchanger, and an expansion assembly, and a second heat exchanger interconnected by a first piping loop, the first piping loop circulating a hydrocarbon refrigerant. A cooling loop circulates a cooling fluid in heat exchange relationship with the hydrocarbon refrigerant within the second heat exchanger, the cooling loop including a pump interconnected with the second heat exchanger and a third heat exchanger by a second piping loop, wherein the third heat exchanger is in heat exchange relationship with an airflow passing through the third heat exchanger, and wherein the airflow is in communication with a space adapted to support product to be cooled.

The invention provides, in another aspect, a merchandiser having a case defining a product support area and a refrigeration loop. The refrigeration loop includes a compressor, a heat exchanger, an expansion assembly, and an evaporator fluidly interconnected with each other, the evaporator being disposed in the case, and the refrigeration loop circulating a hydrocarbon refrigerant in heat exchange relationship with an airflow within the case to condition the product support area, wherein the evaporator includes a single, continuous coil through which the hydrocarbon refrigerant is circulated.

Other features and aspects of the invention will become apparent by consideration of the following detailed description and accompanying drawings.

Figure 1:
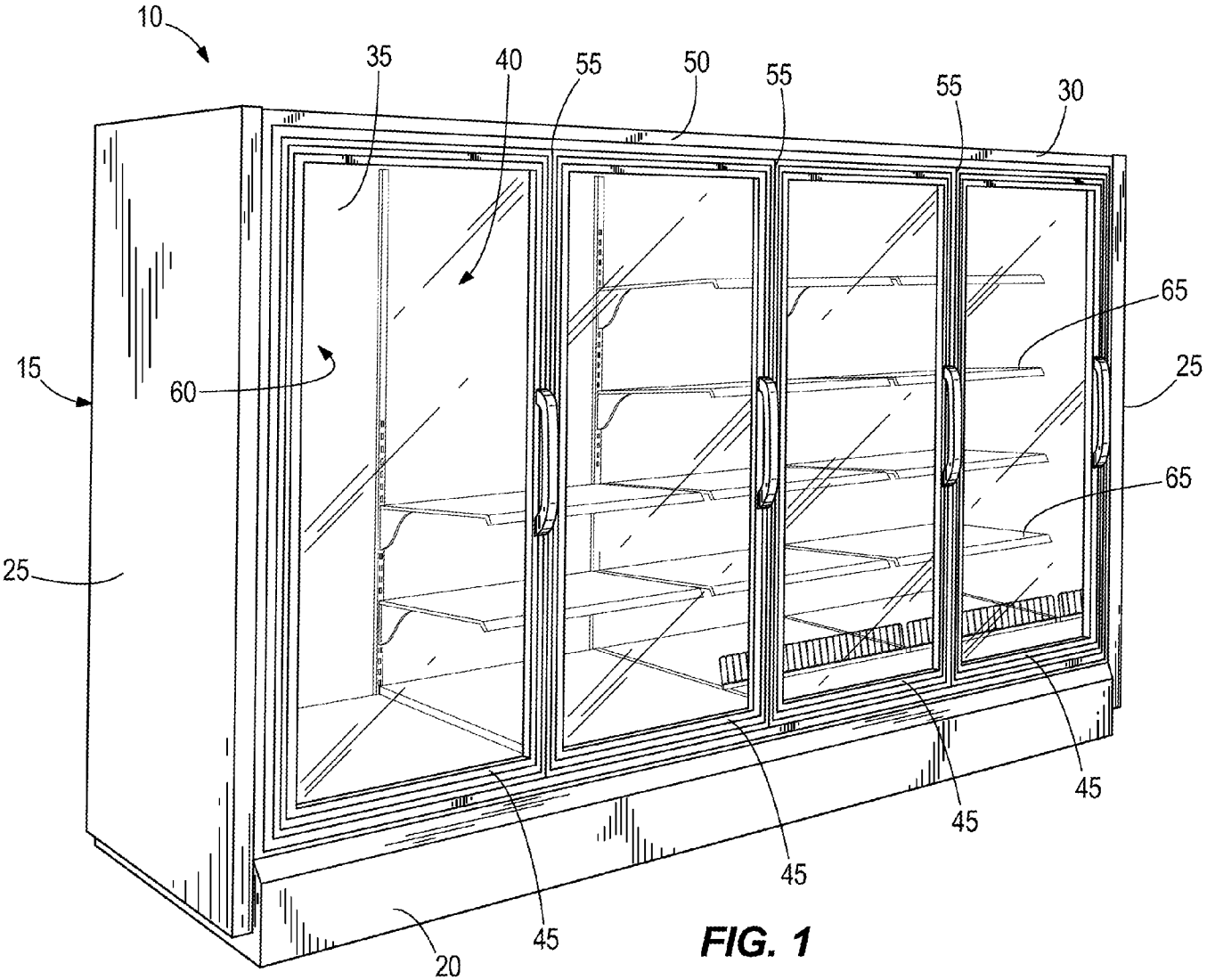
FIG. 1 is a perspective view of an exemplary refrigerated merchandiser embodying the invention.

Before any embodiments of the present invention are explained in detail, it should be understood that the invention is not limited in its application to the details or construction and the arrangement of components as set forth in the following description or as illustrated in the drawings. The invention is capable of other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

The invention illustrated in the Figures and disclosed herein is generally directed to a multi-stage modular refrigeration system 100, 200, 300 for a merchandiser 10. The system 100, 200, 300 includes a charge of hydrocarbon refrigerant (e.g., propane) not only within regulatory requirements, the system 100, 200, 300 also includes a single refrigerant loop charged with hydrocarbon refrigerant. For example, the refrigerant charge of the total system does not exceed 150 grams of hydrocarbon refrigerant. Thus, the merchandiser 10 will have a reduced total amount of hydrocarbon refrigerant over known merchandisers. By implementing the multi-stage system disclosed herein, a larger cooling load is placed upon the hydrocarbon refrigerant to provide fewer refrigeration circuits relative to known merchandisers. Eliminating additional refrigeration circuits in turn eliminates additional components, including, but not limited to, piping, compressor(s), condenser(s), and/or control technology to operate a plurality of parallel refrigeration circuits.

FIG. 1 illustrates an exemplary refrigerated merchandiser 10 including a case 15 that has a base 20 and opposing sidewalls 25. The case 15 also includes a top or canopy 30 and a rear wall 35 positioned opposite an access opening 40. Although the illustrated merchandiser 10 includes a plurality of doors 45 covering the access opening 40, the merchandiser 10 can be an open-front merchandiser without doors. The doors 45 are mounted to a frame 50 that includes mullions 55 separating each of the doors 45. Doors 45 may be hinged or sliding doors. The case 15 defines a product support area 60 and has shelves 65 coupled to the rear wall 35 to support product in the product support area 60. The merchandiser 10 is illustrated as a singular case with one section and one product support area 60 defined by the section. As will be appreciated, the merchandiser can include one or more sections, with each section defining a product support area that makes up the overall product support area 60 of the merchandiser 10.

Although the merchandiser 10 is illustrated as a vertical merchandiser, the merchandiser 10 can take other forms (e.g., a horizontally-oriented merchandiser), or another type of structure (e.g., a storage room) including a conditioned product support area. Also, the merchandiser 10 can be a low temperature merchandiser supporting product conditioned to temperatures less than approximately 32 degrees Fahrenheit, or a medium temperature merchandiser that conditions product to temperatures generally within a temperature range of approximately 32 degrees Fahrenheit to approximately 41 degrees Fahrenheit. Further, merchandiser 10 may be configured to maintain any desired temperature or range of temperatures in product support area 60. In addition, merchandiser 10 may be an open air merchandiser, a reach-in refrigerator, a floral merchandiser, a wine merchandiser, a dual service merchandiser, or any other known or future developed refrigerated merchandiser for use with the multi-stage modular refrigeration system 100, 200, 300 that is described in detail below.

Figure 2:
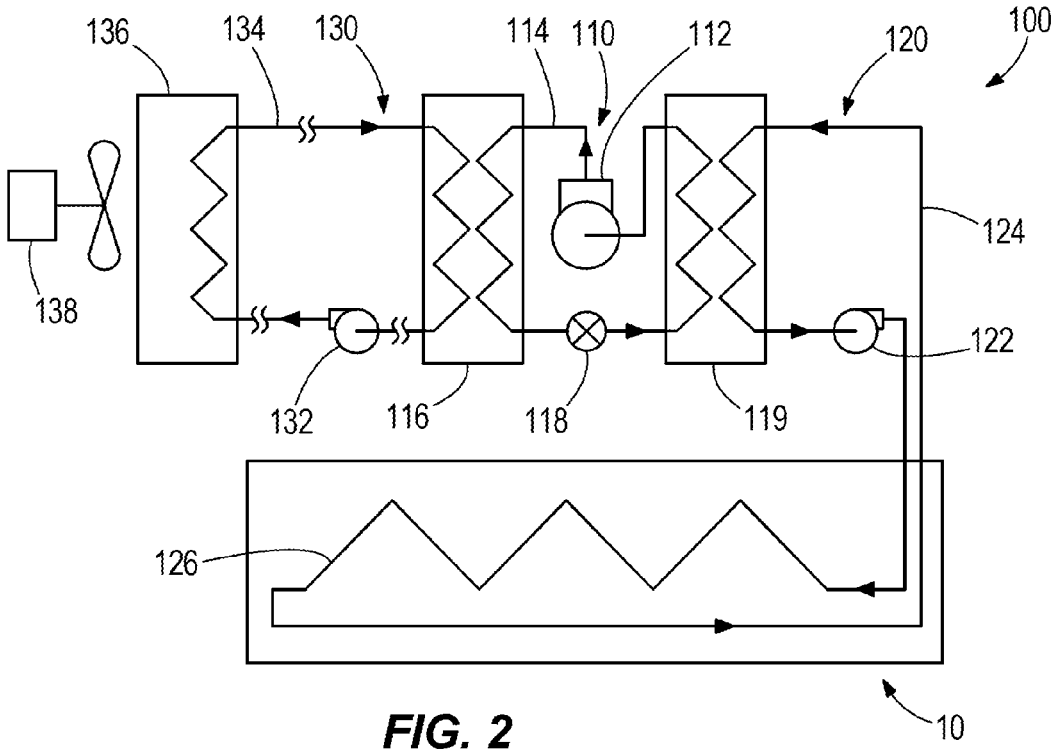
FIG. 2 is a schematic view of an exemplary multi-stage modular refrigeration system embodying the invention.
Figure 3:
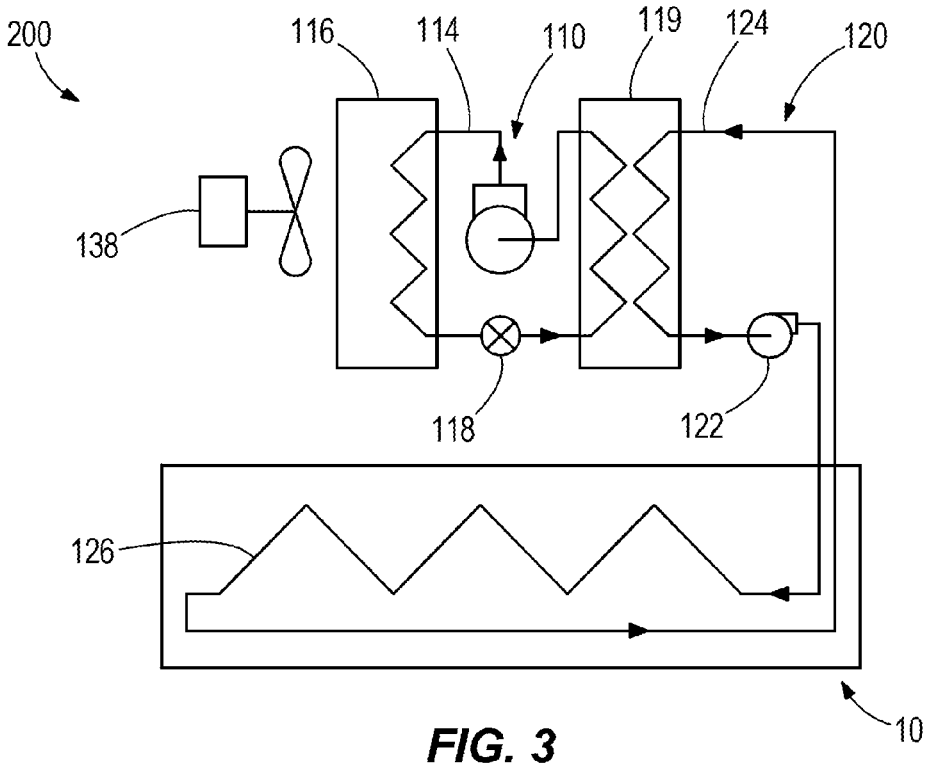
FIG. 3 is a schematic view of another exemplary multi-stage modular refrigeration system similar to the system of FIG. 2, wherein the low side includes a fluid loop and the high side includes an air-cooled condenser.
Figure 4:
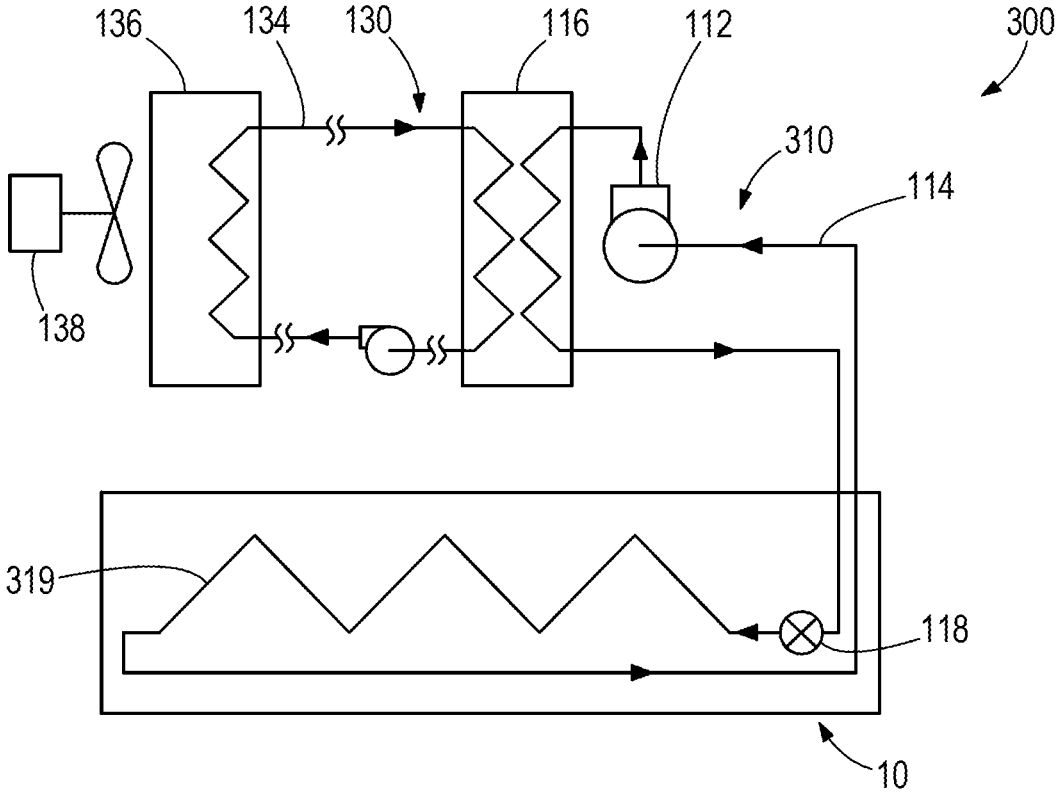
FIG. 4 is a schematic view of another exemplary multi-stage modular refrigeration system similar to the system of FIG. 2, wherein the low side includes an evaporator and the high side includes a fluid loop.

FIGS. 2-4 illustrate exemplary multi-stage modular refrigeration systems 100, 200, 300 for providing refrigeration to the merchandiser 10. Referring to FIG. 2, the multi-stage modular refrigeration system 100 includes circuits or fluid loops 110, 120, 130 arranged in heat transfer relationship to provide refrigeration to the merchandiser 10. The illustrated refrigeration loop 110 circulates a hydrocarbon refrigerant (e.g., propane) and is defined as a vapor-compression refrigeration loop (referred to as the "refrigeration loop 110" for purposes of description only). More specifically, the refrigeration loop 110 includes a compressor 112, a condenser 116, an expansion assembly 118, and a chiller 119. The compressor 112 is in fluid connection with the condenser 116 via piping 114, which also fluidly connects the condenser 116 to the expansion assembly 118, the expansion assembly 118 to the chiller 119, and the chiller 119 to the compressor 112 to form the refrigeration loop 110.

The compressor 112 may be any suitable mechanical assembly for increasing the pressure of the hydrocarbon refrigerant within refrigeration loop 110. The condenser 116 may be any suitable heat exchanging assembly for condensing hydrocarbon refrigerant from a gaseous state to a liquid state, and transferring heat away from the hydrocarbon refrigerant. The expansion assembly 118 may be any suitable flow-restricting or metering assembly causing a reduction in pressure of the hydrocarbon refrigerant, including, but not limited to, an expansion valve that may be either internally equalized or externally equalized. The chiller 119 may be any suitable heat exchanging assembly for transferring heat from a chilled fluid to the hydrocarbon refrigerant.

The refrigeration loop 110 may be hermetically sealed to avoid discharge or loss of the hydrocarbon refrigerant. The refrigeration loop 110 provides for cycling or circulation of hydrocarbon refrigerant within the loop from the compressor 112 to the condenser 116, through the expansion assembly 118 to the chiller 119, and return to the compressor 112. Preferably, the refrigeration loop 110 will have a refrigeration charge of hydrocarbon refrigerant that does not exceed government limits for such refrigerants, and is within regulatory requirements. For example, the refrigeration loop 110 has a refrigerant charge limit of no more than 150 grams of hydrocarbon refrigerant such as propane. It should be appreciated that the term "hydrocarbon refrigerant" used herein may include other classifications of flammable or toxic refrigerants, including A2L rated refrigerants. Other refrigerants may have alternative refrigerant charge limit regulations. For example, an A2L rated refrigerant has a charge limit of 500 grams.

With continued reference to FIG. 2, the refrigeration system 100 also includes a second circuit or fluid loop or low side loop 120 (referred to as the "low side loop 120" for purposes of description only). The low side loop 120 may be a low side chilled fluid loop that provides a chilled fluid to refrigerate or otherwise maintain a desired temperature of the merchandiser 10. The chilled fluid can include hydrofluoroether (HFE), or another chilled fluid suitable for providing refrigeration to the merchandiser 10.

The low side loop 120 includes the chiller 119, a pump 122, and a heat exchanger 126. The pump 122 is in fluid communication with the chiller 119 via loop piping 124. The piping 124 also fluidly connects the chiller 119 to the heat exchanger 126, and the heat exchanger 126 to the chiller 119 to form the loop 120. As illustrated, the heat exchanger 126 defines an evaporator of the merchandiser 10 that conditions the product support area 60 via heat exchange with air that flows through the evaporator prior to being discharged into the product support area 60. The piping 124 may be any suitable material or arrangement to provide a fluid connection within the loop 120 between the chiller 119, the pump 122, and the heat exchanger 126.

The low side loop 120 cycles or circulates the chilled liquid in heat exchange relationship with the hydrocarbon refrigerant in the refrigeration loop 110 within the chiller 119. That is, heat absorbed by fluid circulating within the heat exchanger 126 (due to heat transfer with the air passing through the heat exchanger 126) transfers to the hydrocarbon refrigerant circulating within the refrigeration loop 110 to cool the fluid in the loop 120.

With continued reference to FIG. 2, the refrigeration system 100 also includes a third circuit or fluid loop or high side loop 130 (referred to as the "high side loop 130" for purposes of description only). The high side loop 130 defines a high side cooling fluid loop that circulates a cooling fluid to the condenser 116 to absorb heat from the hydrocarbon refrigerant in the refrigeration loop 110. The cooling fluid can be water or a mixture of water and ethylene glycol, or another suitable coolant.

The high side loop 130 includes the condenser 116, a pump 132, and a heat exchanger 136. The pump 132 is fluidly connected to the condenser 116 by loop piping 134. The piping 134 also fluidly connects the condenser 116 to the heat exchanger 136, and the heat exchanger 136 to the condenser 116 to form the high side loop 130. One or more fans 138 can be provided at the heat exchanger 136 to assist in discharging heat from the cooling fluid. The piping 134 may be any suitable material or arrangement to provide a fluid connection within the loop 130 between the condenser 116, the pump 132, and the heat exchanger 136. The heat exchanger 136 may be any suitable assembly for transferring heat from the cooling fluid in the loop 130. For example, the heat exchanger 136 may include, but is not limited to, an air-to-fluid or air-to-water heat exchanger.

The high side loop 130 is in heat exchange relationship with the refrigeration loop 110 within the condenser 116. More specifically, heat in the hydrocarbon refrigerant is absorbed by the cooling fluid circulating through the high side loop 130 within the condenser 116 to cool the hydrocarbon refrigerant, which in turn absorbs heat from the low side loop 120 as described above.

The components of the refrigeration, low side, and high side loops 110, 120, 130 may be positioned together at a single location such as at the merchandiser 10. For example, one or more of the refrigeration, low side, and/or high side loops 110, 120, 130 may be provided on the canopy 30 and/or within the base 20 of merchandiser 10. In another example, some or all of the components of the high side loop 130 may be positioned at a remote location from the refrigeration and/or low side loops 110, 120. More specifically, the pump 132, the heat exchanger 136, and/or the fans 138 may be provided at a remote location away from the refrigeration and/or the low side loops 110, 120. In addition, the low side and/or the high side loops 120, 130 may be assembled as separate modules. The modular assembly will allow for an end user to optionally use existing equipment in place of one or more modules. For example, an end user may omit a module and instead use one or more existing pumps, piping, and/or heat exchangers in the loops 120, 130.

In operation of the refrigeration system 100, hydrocarbon refrigerant is cycled through refrigeration loop 110. The hydrocarbon refrigerant flows from the chiller 119 to the compressor 112, which compresses the hydrocarbon refrigerant in a gas phase. The compressor 112 also acts as the circulation device for the hydrocarbon refrigerant within the refrigeration loop 110. Compressed hydrocarbon refrigerant exits the compressor 112 and travels to the condenser 116. In the condenser 116, heat from the gas phase hydrocarbon refrigerant transfers to the cooling fluid circulating through the high side loop 130. Heat transfer within the condenser 116 condenses the hydrocarbon refrigerant from a gas to a gas-liquid mixture or liquid. The condensed hydrocarbon refrigerant exits the condenser 116 and travels to the expansion assembly 118, which restricts the flow of hydrocarbon refrigerant traveling to the chiller 119, causing a drop in pressure. The drop in pressure results in the hydrocarbon refrigerant changing phase to a gas. This direct expansion of the hydrocarbon refrigerant in the chiller 119 cools the fluid circulating through the low side loop 120. More specifically, the hydrocarbon refrigerant absorbs heat from the fluid in the low side loop 120 within the chiller 119. The heated hydrocarbon refrigerant exits the chiller 119 and returns to the compressor 112, where the cycle repeats.

As hydrocarbon refrigerant cycles through the refrigeration loop 110, fluid also cycles through the low side loop 120 and cooling fluid cycles through the high side loop 130. In the low side loop 120, the pump 122 acts as the circulation device for the fluid. The fluid exits the pump 122 and travels to the heat exchanger 126, where the fluid is heated by heat exchange with warmer air flowing through the heat exchanger 126 to cool the air. The heated fluid then flows to the chiller 119, where the fluid is cooled by heat exchange with the hydrocarbon refrigerant (by direct expansion of the hydrocarbon refrigerant). The chilled fluid exits the chiller 119 and returns to the pump 122.

In the high side loop 130, the pump 132 acts as the circulation device for the cooling fluid. The cooling fluid exits the pump 132 and travels to the heat exchanger 136, where the temperature of the cooling fluid decreases due to rejection of heat to the surrounding environment. The lower temperature cooling fluid exits the heat exchanger 136 and flows to the condenser 116. In the condenser 116, the cooling fluid is heated via heat exchange with the hydrocarbon refrigerant (i.e. the cooling fluid absorbs heat from the hydrocarbon refrigerant). The higher temperature cooling fluid exits the condenser 116, and travels to the pump 132, where the cycle repeats.

FIG. 3 illustrates another exemplary multi-stage modular refrigeration system 200. Except as described below, the multi-stage modular refrigeration system 200 is the same as the refrigeration system 100 described with regard to FIG. 2, and common elements are given the same reference numerals.

Referring to FIG. 3, the refrigeration system 200 includes the refrigeration loop 110 and the low side loop 120. However, refrigeration system 200 does not include a high side loop, such as loop 130 in FIG. 2. Instead, the system 200 includes one or more fans 138 that are positioned in communication with the condenser 116 to direct air through the condenser 116. The air acts as a medium to cool the propane refrigerant within the condenser without an intermediate cooling fluid as described and illustrated with regard to FIG. 2.

FIG. 4 illustrates yet another exemplary multi-stage modular refrigeration system 300. Except as described below, the multi-stage modular refrigeration system 200 is the same as the refrigeration system 100 described with regard to FIG. 2, and common elements are given the same reference numerals.

The refrigeration system 300 includes the high side loop 130 and a low side refrigeration loop 310. As illustrated, the refrigeration loop 310 circulates a hydrocarbon refrigerant (e.g., propane) and includes an evaporator 319 that is positioned in the merchandiser 10 to condition the product support area 60 via heat exchange with air flowing through the evaporator 319. The refrigeration loop 310 may be hermetically sealed to avoid discharge or loss of hydrocarbon refrigerant. The compressor 112 compresses hydrocarbon refrigerant and acts as the circulation device for the loop 310. Accordingly, refrigerant flows from the compressor 112 to the condenser 116, and then exits the condenser 116 and travels through the expansion assembly 118 to the evaporator 319 before returning to the compressor 112. Refrigeration loop 310 has a refrigerant charge that is no more than 150 grams of hydrocarbon refrigerant.

In operation of the refrigeration system 300, hydrocarbon refrigerant is circulated through the refrigeration loop 310 to cool air that is eventually directed to the product support area 60 to condition product supported therein. Heated hydrocarbon refrigerant from the evaporator 319 is compressed by the compressor 112 and then cooled via heat exchange with the cooling fluid in the high side loop 130 within the condenser 116.

By utilizing fluid loops arranged in heat transfer relationship, the refrigeration system 100, 200, 300 reduces the total hydrocarbon refrigerant needed to refrigerate the product support area 60 by increasing the cooling load on the hydrocarbon refrigerant. Unlike known systems, the series arrangement of fluid loops and use of hydrocarbon refrigerant provides a single hydrocarbon refrigerant loop that maintains the area 60 within the desired parameters.

Further, the series arrangement of fluid loops eliminates or at least reduces duplicative refrigeration components (e.g., pumps, compressors, piping, etc.) within the system 100, 200, 300. In addition, the modular assembly of multistage loops 110, 120, 130, 310 allows an end user to optionally utilize existing equipment in place of one or more modules while still maximizing the use of hydrocarbon refrigerant. For example, an end user may omit a module and instead use one or more existing pumps, piping, and/or heat exchangers in place of the omitted module.

Various features and advantages of the invention are set forth in the following claims.

The invention claimed is:

1. A refrigeration system comprising:

a refrigeration loop including a compressor, a first heat exchanger, and an expansion assembly, and a second heat exchanger interconnected by a first piping loop, the first piping loop circulating a hydrocarbon refrigerant; and a cooling loop circulating a cooling liquid in direct heat exchange relationship with the hydrocarbon refrigerant within the second heat exchanger, the cooling loop including a pump configured to circulate the cooling liquid through the cooling loop and interconnected with the second heat exchanger and a third heat exchanger by a second piping loop, wherein the first heat exchanger is in heat exchange relationship with an airflow passing through the first heat exchanger, and wherein the airflow is in communication with a space adapted to support product to be cooled, and wherein the third heat exchanger rejects heat to an ambient environment.

2. The refrigeration system of claim 1, wherein the first heat exchanger includes an evaporator and the space is defined by a refrigerated merchandiser.

3. The refrigeration system of claim 1, wherein the second heat exchanger includes a condenser.

4. The refrigeration system of claim 1, wherein the hydrocarbon refrigerant is propane.

5. The refrigeration system of claim 1, wherein the total amount of hydrocarbon refrigerant charge in the system does not exceed 150 grams.

6. The refrigeration system of claim 1, wherein the cooling liquid includes water and the third heat exchanger includes an air-to-water heat exchanger.

* * * * *